US006368088B1

(12) United States Patent
Hsiao et al.

(10) Patent No.: US 6,368,088 B1
(45) Date of Patent: Apr. 9, 2002

(54) SCROLL COMPRESSOR WITH BACK PRESSURE REGULATION MECHANISM

(75) Inventors: Tse-Liang Hsiao; Ching-Feng Lai; Kun-I Liang; Yu-Choung Chang; Chun-Chung Yang, all of Hsinchu Hsian (TW)

(73) Assignee: Industrial Technology Research Institute, Hsinchu Hsian (TW)

( * ) Notice: Subject to any disclaimer, the term of this patent is extended or adjusted under 35 U.S.C. 154(b) by 0 days.

(21) Appl. No.: 09/747,998

(22) Filed: Dec. 27, 2000

(51) Int. Cl.[7] ..... F04C 18/04; F04C 29/10
(52) U.S. Cl. ..... 418/55.4; 418/55.5; 418/57
(58) Field of Search ..... 418/55.5, 57, 55.4

(56) References Cited

U.S. PATENT DOCUMENTS 5,192,202 A * 3/1993 Lee ..... 418/55.5
5,474,433 A * 12/1995 Chang et al. ..... 418/55.5
6,048,184 A * 4/2000 Chang et al. ..... 418/55.5

* cited by examiner

*Primary Examiner*—John J. Vrablik
(74) *Attorney, Agent, or Firm*—Rosenberg, Klein & Lee

(57) ABSTRACT

A back pressure regulation mechanism is incorporated in a scroll compressor. The compressor includes a fixed scroll and a spacing member fixed inside a casing to define a high pressure chamber behind the fixed scroll. The back pressure regulation mechanism includes a boss formed on the fixed scroll and extending through the spacing member into the high pressure chamber whereby a first force caused by pressure difference acts upon the boss and thus the fixed scroll, a plurality of bores defined in the spacing member, each bore being in communication with the high pressure chamber and the fixed scroll, and a back pressure regulation device accommodated in each bore and including a pin received in the bore and movable between upper and lower limit positions, a washer engaging the fixed scroll and a disk spring arranged between the pin and the washer. A second force caused by the pressure difference acts upon the pin and is transmitted to the fixed scroll via the disk spring and the washer. The second force is proportional to the pressure difference when the pin is moving from the upper limit position to the lower limit position and the second force becomes a constant when the pin reaches the lower limit position. The first and second forces together provide a back pressure to the fixed scroll.

12 Claims, 8 Drawing Sheets

SCROLL COMPRESSOR WITH BACK PRESSURE REGULATION MECHANISM

BACKGROUND OF THE INVENTION

1. Field of the Invention

The present invention generally relates to a mechanism for regulating back pressure of a scroll compressor. More particularly, the present invention relates to a mechanism for automatically regulating back pressure of a fixed scroll of a scroll compressor.

2. Background of the Invention

Scroll compressors have been widely employed in air conditioners. An example of the scroll compressors is shown in Taiwan Patent Publication No. 263024. FIG. 1 of the attached drawings shows a conventional scroll compressor. The conventional scroll compressor comprises a pair of scrolls, respectively called fixed scroll 10 and rotating scroll 11. The fixed scroll 10 is in general fixed and thus not rotatable, while the rotating scroll 11 is rotatable with respect to the fixed scroll 10. The rotation of the rotating scroll 11 drives working fluid, such as coolant, from a low pressure chamber 12 located on the back side of the rotating scroll 11 to a high pressure chamber 13 located on the back side of the fixed scroll 10 and thus compressing the working fluid.

Also referring to FIG. 7 which shows plots of the back pressure and scroll separation force of a scroll compressor vs. pressure difference between the high pressure chamber 13 and the low pressure chamber 12. In FIG. 7, Curve A represents the scroll separation force occurring during the operation of the scroll compressor. The term "scroll separation force" as used herein indicates the force caused by the compressed working fluid acting between and thus tending to separate the fixed scroll 10 and the rotating scroll 11. This may lead to leakage of the compressed working fluid between the scrolls 10.

The scroll separation force changes in accordance with the operation conditions of the compressor. An example of the operation conditions of the scroll compressor that affects the scroll separation force is the pressure difference $\Delta P$ between the high pressure chamber 13 and the lower pressure chamber 12 of the scroll compressor. During the operation of the scroll compressor, it is common to make use of the pressure difference between the high pressure chamber 13 and the low pressure chamber 12, serving as a back pressure acting upon the fixed scroll 10, to overcome the scroll separation force and thus eliminating leakage of working fluid between the scrolls 10, 11 caused by the separation of the scrolls 10, 11.

In the conventional design of the scroll compressor shown in FIG. 1, forces caused by the pressure difference $\Delta P$ act upon a boss 100 and a plurality of back pressure carrying pins 14 to provide the desired back pressure for retaining the fixed scroll 10 in position.

Curve B of FIG. 7 shows the distribution of the back pressure employed in the conventional design. In the conventional design, only a single point of the back pressure curve is taken into consideration. Namely, the design is based on a "fixed" back pressure. The fixed point is usually the most frequently occurring back pressure of the scroll compressor, such as pressure difference $\Delta P2$ of FIG. 7. The design is done by adding a desired margin to the corresponding scroll separation force. This is the back pressure desired to overcome the separation force and keep the scrolls 10, 11 together. The back pressure is the sum of the forces acting upon the boss 100 and the pins 14 and it is in general equal to the sum of the scroll separation force plus the safety margin. The overall surface area of the boss 100 and the pins 14 can thus be determined which in turn determines the slope of Curve B.

The conventional design is particularly suitable for scroll compressors that operate under fixed pressure difference. By suitably selecting the overall surface area of the boss 100 and the pins 14, a sufficient back pressure may thus be obtained to overcome the scroll separation force. However, when a scroll compressor does not work in a fixed pressure difference condition, such as the condensation temperature and the evaporation temperature changing with the surroundings, the conventional design suffers the following disadvantages:

(1) When the scroll compressor is operating in a low pressure difference zone, namely the difference between the condensation temperature and the evaporation temperature is small, such as the zone between zero pressure difference and $\Delta P2$ of FIG. 7, the back pressure (Curve B) is close to the scroll separation force (Curve A) causing an insufficiency of back pressure. Satisfactory sealing between the scrolls may not be kept and leakage of working fluid occurs.

(2) When the scroll compressor is operating in a high pressure difference zone, namely the difference between the condensation temperature and the evaporation temperature is large, such as the zone between $\Delta P2$ and $\Delta P3$ of FIG. 7, the situation is reversed. With the increase of the pressure difference, the back pressure acting on the fixed scroll 10 via the boss 100 and the pins 14 is increased and may significantly exceeds the desired back pressure thereby leading to undesired friction and thus wearing between the scrolls 10, 11 and between the rotating scroll 11 and the support frame 15. Damage of the parts and waste of electrical power that is used to drive the rotating scroll 11 may thus be caused.

Increasing the overall surface area of the boss 100 and the pins 14 results in a steep slope of Curve B. This, although helping solving the insufficient back pressure problem encountered in a low pressure difference operation condition, excessively increases the back pressure in the high pressure difference operation condition, resulting in reduction of the service life of the parts. Thus, there always needs a compromise between the leakage problem caused by insufficient back pressure and the wearing problem caused by excessive back pressure.

It is thus desirable to have a back pressure regulation mechanism for overcoming the above mentioned problems.

SUMMARY OF THE INVENTION

Accordingly, an object of the present invention is to provide a back pressure regulation mechanism for a scroll compressor which help maintaining a suitable back pressure for all operation conditions. In other words, when the scroll compressor is operating in a low pressure difference condition, the back pressure regulation mechanism provides a sufficient back pressure to the fixed scroll in order to avoid leakage of the compressed working fluid. On the other hand, when the scroll compressor is operating in a high pressure difference condition, the back pressure regulation mechanism limits the back pressure applied to the fixed scroll to a desired value so as to avoid excessive back pressure acting upon the fixed scroll and thus alleviating wearing occurring on the parts of the compressor.

In accordance with the present invention, the back pressure regulation mechanism comprises a plurality of back pressure regulation devices engaging with the fixed scroll and a boss extending from the fixed scroll. The back pressure regulation devices provide a force acting on the fixed scroll, the force being proportional to the pressure difference during the operation in a low pressure difference zone, while being constant during the operation in a high pressure difference zone. Thus when scroll compressor is operating in the low pressure difference zone, the force provided by the back pressure regulation device, plus a force provided by the boss, both resulting from the pressure difference, is sufficient to compensate the scroll separation force and thus eliminating leakage problem and when the scroll compressor is operating in a high pressure difference zone, the constant force provided by the back pressure regulation devices limit the increased amount of the force acting upon the fixed scroll and thus alleviating the excessive back pressure problem.

An illustrative example of the back pressure regulation device in accordance with the present invention comprises a back pressure carrying pin movably received in a bore and a resilient energy storing element, such as a disk spring is arranged between the pin and the fixed scroll for transmission of the force from the pin to the fixed scroll. The movement of the pin is limited by upper and lower limit positions whereby in the low pressure difference zone, the pin does not reach the lower limit position and the force transmitted to the fixed scroll by the disk spring is proportional to the pressure difference, while in the high pressure difference zone, the pin reaches and is stopped at the lower limit position, the force transmitted to the fixed scroll is thus maintained constant, not changing with the pressure difference.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
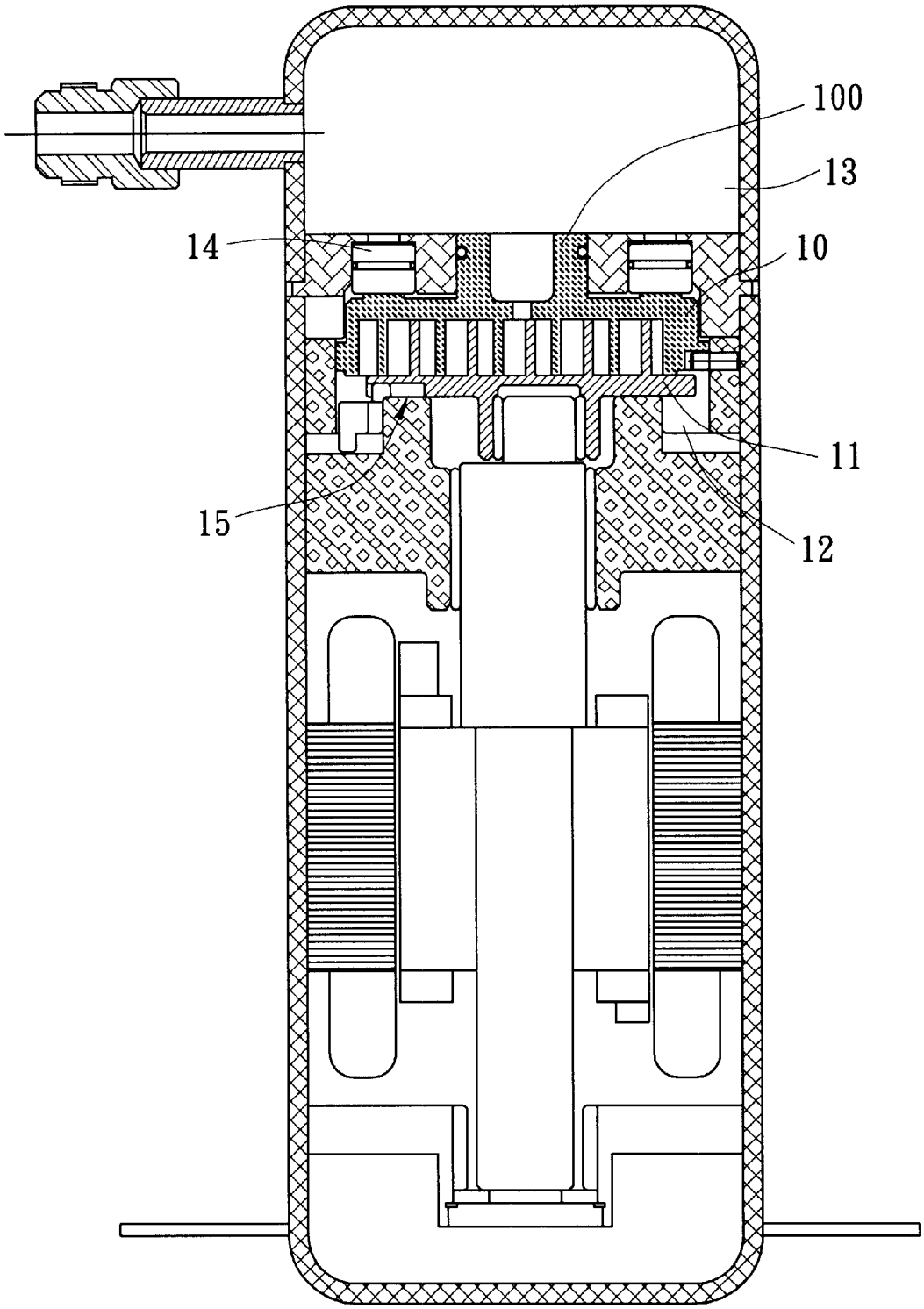
FIG.1 (Prior Art)
FIG. 1 is a cross-sectional view of a conventional scroll compressor.
Figure 2:
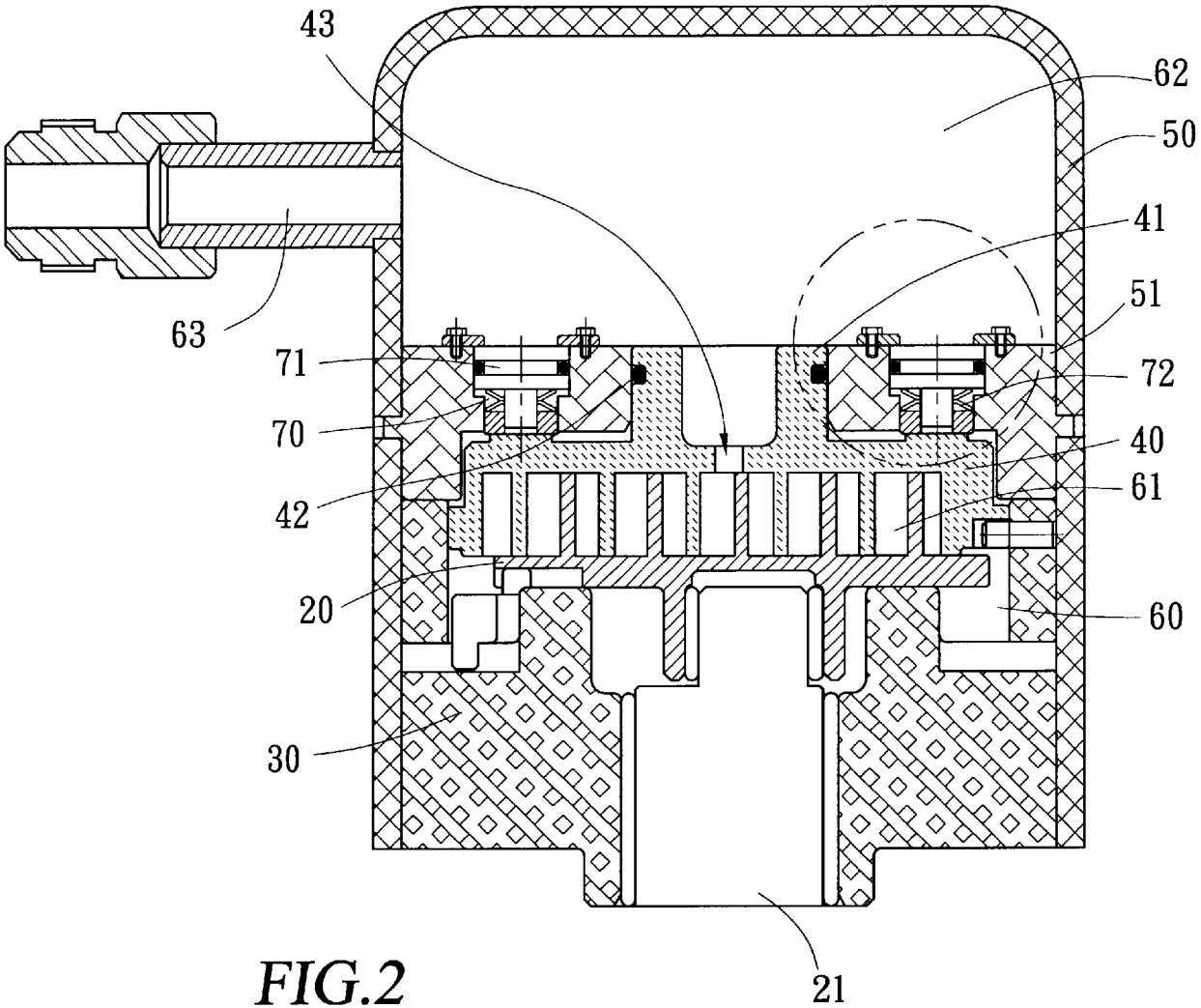
FIG. 2 is a cross-sectional view of a portion of a scroll compressor in accordance with the present invention.

With reference to the drawings and in particular to FIG. 2, wherein a portion of a scroll compressor constructed in accordance with the present invention is shown, the scroll compressor comprises a rotating scroll 20 movably supported by a frame 30. The rotating scroll 20 is coupled to an eccentric shaft 21 for being driven thereby. A fixed scroll 40 is arranged opposite to the rotating scroll 20 and is in general fixed. The fixed scroll 40 comprises a boss 41 extending from a back side thereof in a direction away from the rotating scroll 20. The boss 41 partially extends through a spacing member 51 that is fixed inside a casing 50 of the compressor. The spacing member 51 retains the fixed scroll 40 for allowing relative rotation between the rotating scroll 20 and the fixed scroll 40. An O-ring 42 is arranged around the boss 42 for sealing between the boss 42 and the spacing member 51.

In the operation of the compressor, a working fluid, such as a coolant, flows from a low pressure chamber 60 defined on a back side of the rotating scroll 20, through a compression chamber 61 defined between the rotating scroll 20 and the fixed scroll 40, and then through a passage 43 formed in the fixed scroll 40 to a high pressure chamber 62 defined by the spacing member 51 and the compressor casing 50. The compressed working fluid is then guided out of the compressor through an exit 63. Outside the compressor, the working fluid undergoes evaporation and is then returned to the low pressure chamber 60 to complete a cooling loop.

The boss 41 extends into the high pressure chamber 62 and in fluid communication with the high pressure chamber 62. During the operation of the compressor, a back pressure caused by the pressure difference between the high pressure chamber 62 and the low pressure chamber 60 is applied to the boss 41 from the back side of the fixed scroll 40 for overcoming separation occurring between the fixed scroll 40 and the rotating scroll 20.

Figure 7:
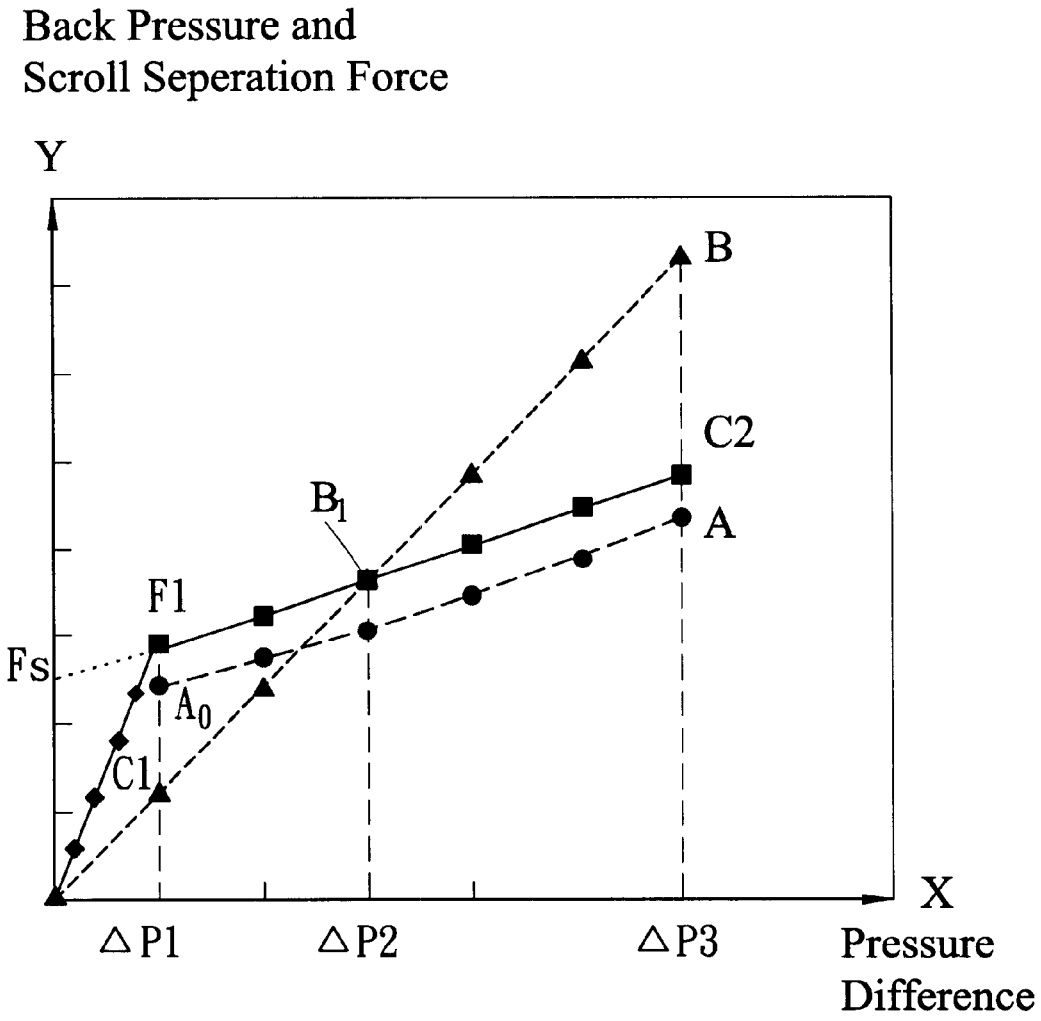
FIG. 7 is a graphic representation of scroll separation force, back pressure distribution of the conventional scroll compressor and back pressure distribution of the present invention.

Also referring to FIG. 7, in accordance with the present invention, during the operation of the compressor, a better distribution of the back pressure caused by the pressure difference $\Delta P$ and applied to the boss 41 and pins 71 is Curve C composed of sections C1 and C2. In a low pressure difference condition, such as that between zero pressure difference and $\Delta P2$, section C1 of Curve C is supposed to provide a sufficient back pressure and the largest back pressure F1 of curve section C1 is greater than the scroll separation force in the same condition, namely starting point A0 of Curve A. In an intermediate or high pressure difference condition, such as that greater than $\Delta P2$, back pressure regulation devices that are incorporated in the compressor in accordance with the present invention will provide a fixed back pressure caused by the pressure difference acting thereupon, while the back pressure caused by the pressure difference acting upon the boss 41 is increased with the pressure difference. The sum of the two kinds of back pressure is just sufficient to overcome the scroll separation force. Thus, the problems caused by insufficient back pressure or excessive back pressure encountered in the prior art is effectively alleviated.

Figure 8:
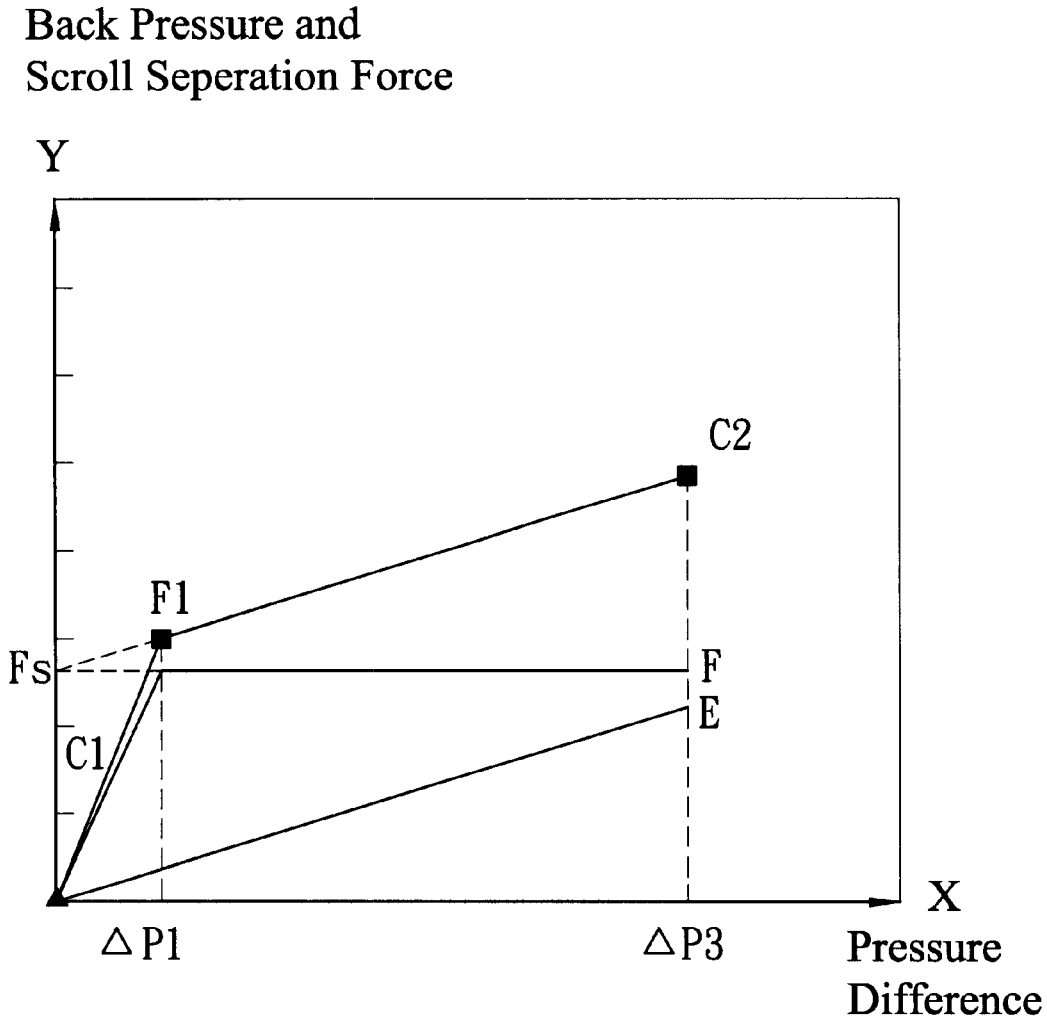
FIG. 8 is a graphic representation of the components of the back pressure in accordance with the present invention.

Curve section C1 of FIG. 7 is a combination of two kinds of back pressure that are respectively applied to the boss 41 and pins 71 of three back pressure regulation devices of the present invention. This is shown in FIG. 8 wherein Curve E represents the back pressure of the boss 41 and Curve F represents the back pressure applied to the pins 71 of the back pressure regulation devices of the present invention. Curve C including sections C1 and C2 is also illustrated in FIG. 8. As shown, Curve C is the sum of Curves E and F.

As shown in FIG. 8, the back pressure of Curves E and F is increased with the pressure difference within the range between zero pressure difference and ΔP1. Within the range between ΔP1 and ΔP3, Curve F is becomes fixed, namely the back pressure associated with the back pressure regulation devices of the present invention is kept constant. Since Curve F is kept constant between ΔP1 and ΔP3, the slope of Curve section C2 is identical to that of Curve E in this range. The slope, as mentioned previously, can be determined by the surface area of the boss 41.

It is desired that the slope of Curve C is close to that of Curve A (namely the curve of the scroll separation force) so as to avoid the problem of excessive back pressure. By suitably designing the boss 41, the area on which the back pressure acts can be selected to provide the desired slope of section C2 of Curve C. Furthermore, by suitably designing the overall area of the pins 71 of the back pressure regulation devices that is acted upon by the back pressure, the largest value F1 of section C1 of Curve C can also be determined whereby a desired Curve C can be obtained.

Figure 3A:
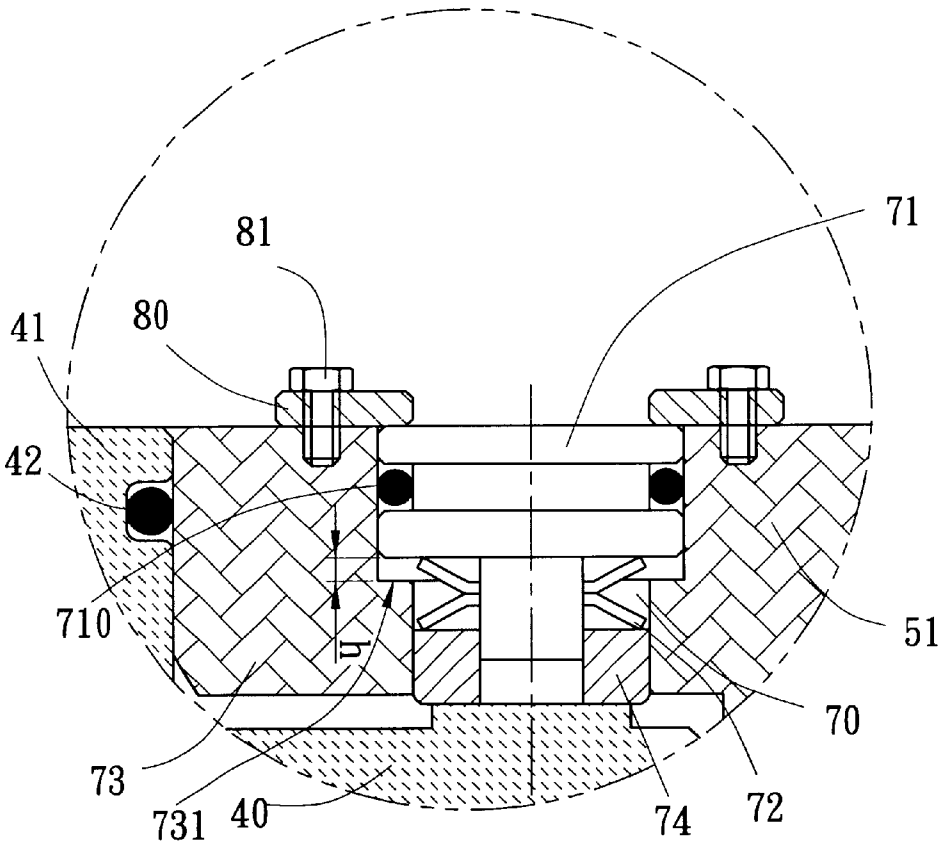
FIG. 3A is an enlarged view of the encircled portion of FIG. 2 showing a back pressure regulation device in accordance with the present invention at an upper limit position.
Figure 3B:
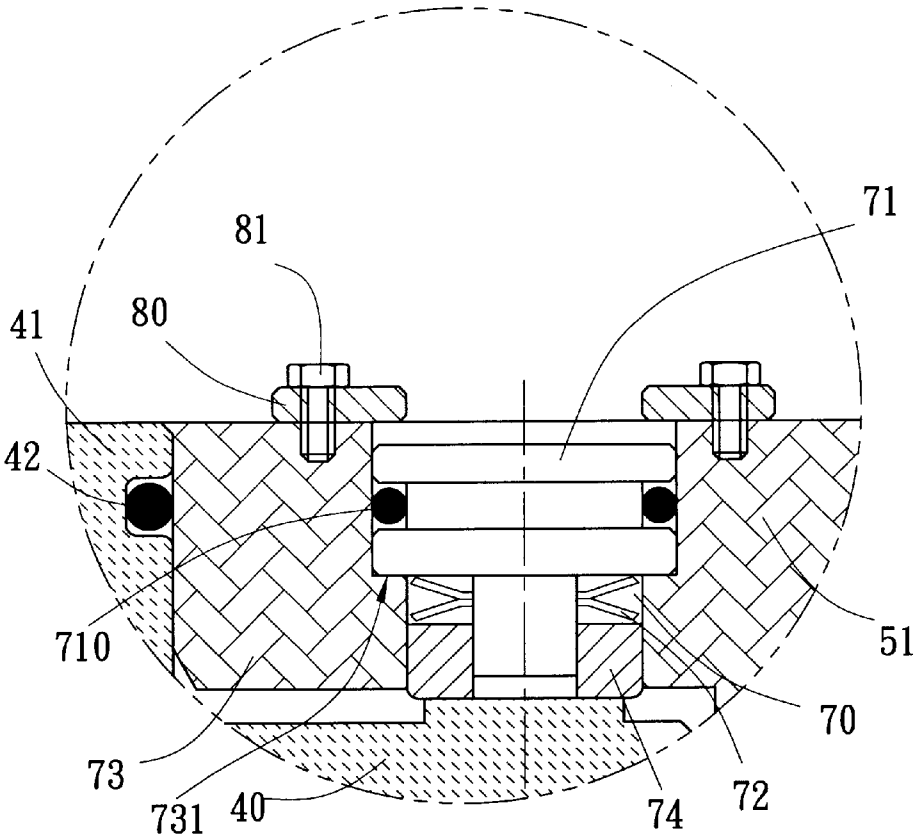
FIG. 3B is similar to FIG. 3A but showing the back pressure regulation device at a lower limit position.
Figure 4:
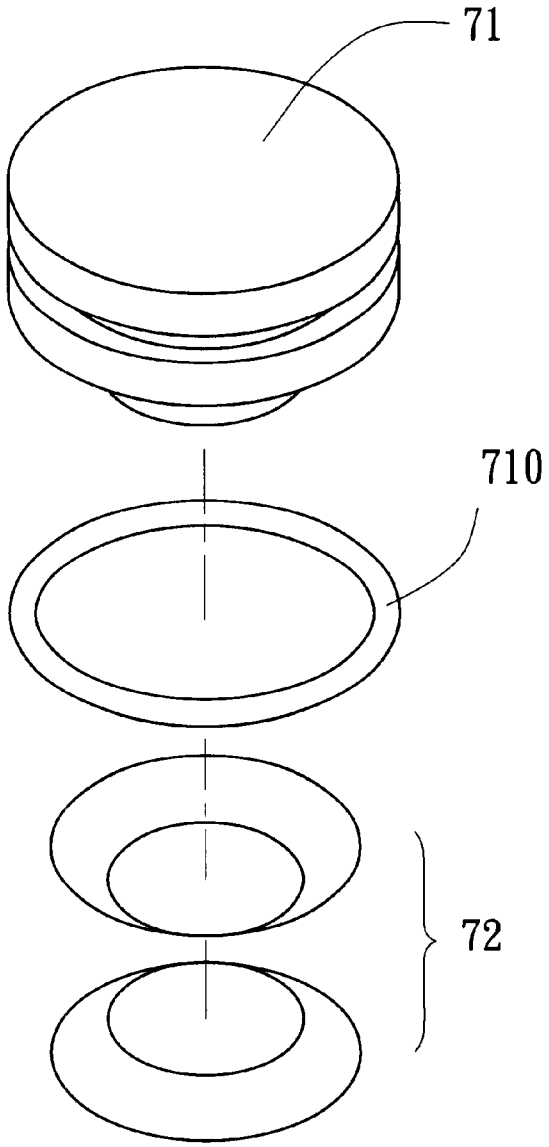
FIG. 4 is an exploded view of a pin of the back pressure regulation device in accordance with the present invention.

Referring to FIGS. 2–4, a back pressure regulation mechanism in accordance with the present invention comprises a plurality of back pressure regulation devices and the boss 41 of the fixed scroll 40. Preferably, three back pressure regulation devices are included in the back pressure regulation mechanism and arranged in an equally spaced fashion concentrically surrounding the boss 41. Each of the back pressure regulation devices is accommodated in a bore 70 defined in and extending through the spacing member 51 for engaging the fixed scroll 40.

Each back pressure regulation device comprises a pin 71 movably received in the bore 70 and is supported by a resilient energy storing element 72 and a lower stroke limiting element 73. In the embodiment illustrated, the energy storing element 72 comprises a spring, preferably a disk spring for the back pressure acting upon the pin 71 may be as large as ten kilogram force. If desired, more than one disk spring may be included in each back pressure regulation device. In the embodiment illustrated, two disk springs arranged in stack are used for each back pressure regulation device.

The lower stroke limiting element 73 is formed by a protrusion from an inner surface of the bore 70 in the form of an annular shoulder 731 or a number of circumferentially spaced segments forming the shoulder. The movement of the pin 71 is stopped by the lower stroke limiting element 73 when an expanded portion of the pin 71 gets into contact with the shoulder 731 (FIG. 3B). The shoulder 731 limits the stroke of the pin 71 toward the fixed scroll 40.

Upper stroke limiting elements 80 are attached to the spacing member 51 by means of bolts or rivets 81 and partially protrude into the bore 70. The upper stroke limiting elements 80 stop the movement of the pin in a direction away from the fixed scroll 40 when the expanded portion of the pin 71 gets into contact with the upper stroke limiting elements 80. Thus the movement of the pin 71 is limited by the upper stroke limiting element 80 and the shoulder 731 of the lower stroke limiting element 73.

The expanded portion of the pin 71 has a cross-sectional area substantially identical to that of the bore 70 and is allowed to freely move in the bore 70. An O-ring 710 is disposed between the pin 71 and an inner surface of the bore 70 for sealing purposes so that pressure of the working fluid in the high pressure chamber 62 may effectively act on the pin 71.

Although in the embodiment illustrated, the upper stroke limiting elements 80 are fixed by bolts 81, other means, such as a C-ring fixed inside the bore 70 for stopping movement of the pin 71 away from the fixed scroll 40, may also be employed.

The energy storing element 72 is arranged between the pin 71 and a washer 74 positioned on the fixed scroll 40. The pressure of the working fluid in the high pressure chamber 62 is transmitted through the pin 71, the energy storing element 72 and the washer 74 to the fixed scroll 40. As shown in FIG. 3A, when the pin 71 is located at an upper limit position defined by the upper stroke limiting elements 80, the operation of the compressor causes the pressure inside the high pressure chamber 62 to increase. The high pressure of the high pressure chamber 62 gradually drives the pin 71 toward the fixed scroll 40. The energy storing element 72 is then deformed and storing energy therein and at the same time transmits the back pressure to the fixed scroll 40 via the washer 74. This corresponds to the low pressure difference condition between zero and ΔP1 of FIG. 7, namely the sloped section of Curve F.

When the pin 71 reaches a lower limit position defined by the shoulder 731 of the lower stroke limiting element 73, the energy storing element 72 can no longer be deformed by the pin 71. The force acting upon the fixed scroll 40 by the energy storing element 72 becomes a constant Fs thereafter. This corresponds to the flat section of Curve F.

The following formulae show the relationship between the spring constant of the energy storing element 72, the pressure acting area of the pin 71, the stroke of the pin 71 and pressure acting area of the boss 41.

For section C1 of Curve C:

$$\text{Back pressure } (F)=(A1+(N\cdot A2))\cdot X \tag{1}$$

where A1 is the pressure acting area of boss 41, A2 is the pressure acting area for each pin 71 and N is the number of pins 71 (which is three in this case). X denotes pressure difference ΔP between 0–ΔP1. F is the desired back pressure between 0–F1.

Fore section C2 of Curve C:

$$\text{Back pressure } (F)=Fs+(A1\cdot X) \tag{2}$$

and $$Fs=((K/2)\cdot h)\cdot N \tag{3}$$

where Fs is a constant, K is the spring constant of each disk spring 72 and h is the stroke of the pin 71 (namely the deformation of the disk springs 72). Since two disk springs 72 are stacked together in each back pressure regulation devices, the overall spring constant of the disk springs 72 for each back pressure regulation device is K/2.

Referring to FIG. 8, the disk springs 72 undergo deformation when the pressure difference is increased from 0 toward ΔP1. When the pressure difference reaches ΔP1, the disk springs 72 take the largest deformation. The energy stored in the disk springs 72 at this moment is corresponding to the constant back pressure Fs. Thus ΔP1 can be obtained as follows:

$$Fs=(A2\cdot N)\cdot \Delta P1$$

$$\Delta P1=Fs/(A2\cdot N) \tag{4}$$

The greater the pressure acting area A2 of the pin 71 is, the smaller the pressure difference ΔP1 is and greater the slope of curve section C1 will be and vice versa.

Based on equation (4), it is possible to calculate the pressure acting area A2 of the pin 71 in accordance with a desired pressure difference ΔP1. As shown in FIG. 8, curve section C2 is the sum of the back pressure of the boss 41 and the back pressure of the pins 71. By extrapolating the section C2 of Curve C, an intersection with the ordinate of FIG. 8 indicates the constant back pressure Fs provided by the pins 71 for at this condition, there is theoretically no pressure difference and the back pressure provided by the boss 41 which is purely proportional to the pressure difference is none. This allows a designer to determine the specification of the energy storing element 72.

Also, at the point ΔP1, the overall pressure force F1 is equal to Fs (back pressure provided by the pins 71) plus back pressure provided by the boss 41. Knowing the pressure acting area A1 allows a designer to determine the pressure acting area A2 of the pins 71.

Figure 6:
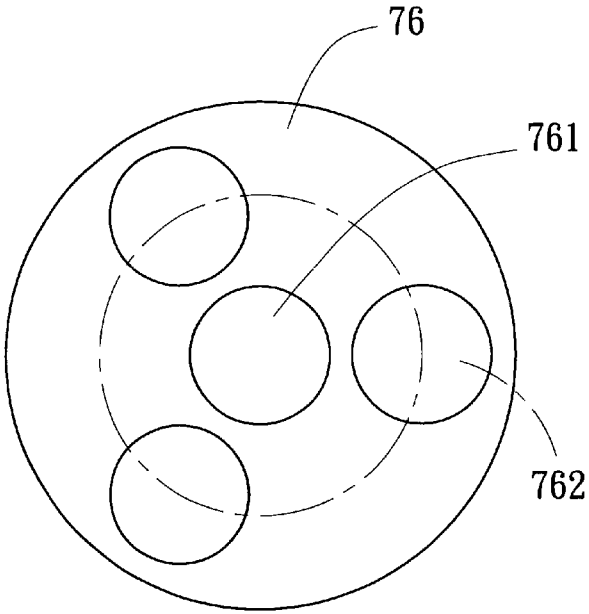
FIG. 6 is a plan view of a stop disk adapted in the scroll compressor of FIG. 5.
Figure 5:
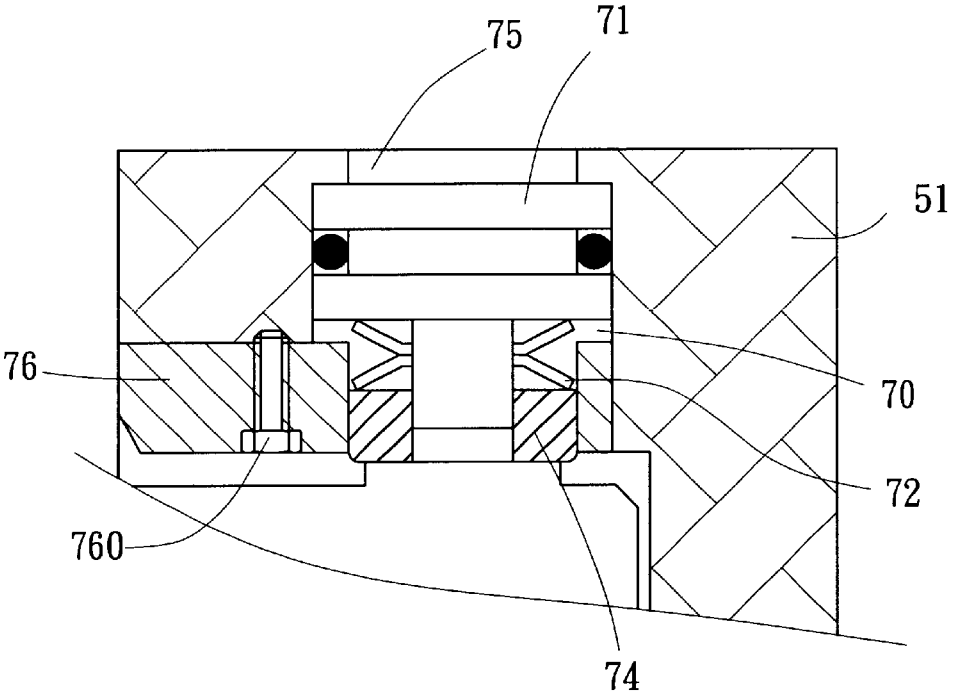
FIG. 5 is a cross-sectional view of a portion of a scroll compressor in accordance with another embodiment of the present invention.

FIGS. 5 and 6 show another embodiment of the back pressure regulation device in accordance with the present invention. In the embodiment shown in FIGS. 5 and 6, a circumferential protrusion forming a shoulder 75 or a plurality of circumferentially spaced segments that form the shoulder 75 are formed on an inner surface of each bore 70 for serving as upper stroke limiting elements. A stop disk 76 is attached to the spacing member 51 by means of bolts 760 and located between the spacing member 51 and the fixed scroll 40 to serve as the lower stroke limiting element. The stop disk 76 defines a central hole 761 through which the boss 41 extends. A secondary hole 762 having a diameter smaller than that of the bores 70 is defined in the stop disk 76 corresponding to each pin 71 which, when getting into contact with the expanded portion of the pin 71, limits the movement of the pin 71. Energy storing elements 72 and a washer 74 are sequentially arranged between the expanded portion of the pin 71 and the fixed scroll 40 to transmit the back pressure to the fixed scroll 40.

To this point, it is understood that the present invention provides at least the following advantages:

(1) Providing a sufficient back pressure in a low pressure difference condition for preventing leakage of the working fluid; and (2) Eliminating excessive back pressure in a high pressure difference condition for improving operation efficiency, reducing waste of electrical power and extending service life of the parts.

Although the present invention has been described with reference to the preferred embodiments, it is apparent to those skilled in the art that a variety of modifications and changes may be made without departing from the scope of the present invention which is intended to be defined by the appended claims.

What is claimed is:

1. A back pressure regulation mechanism adapted to be incorporated in a scroll compressor comprising a fixed scroll and a spacing member fixed inside a casing to define a high pressure chamber behind the fixed scroll, the back pressure regulation mechanism comprising:

a boss formed on a back side of the fixed scroll and extending through the spacing member into the high pressure chamber whereby a first force caused by pressure difference acts upon the boss and thus the fixed scroll;

a plurality of bores defined in the spacing member and concentrically surrounding the boss, each bore being in communication with the high pressure chamber and the fixed scroll; and a back pressure regulation device accommodated in each of the bores, comprising a pin received in the bore and movable between an upper limit position stop and a lower limit position stop, a washer engaging the fixed scroll and resilient energy storing means arranged between the pin and the washer, a second force caused by the pressure difference acting upon the pin and transmitted to the fixed scroll via the resilient energy storing means and the washer, the second force being proportional to the pressure difference when the pin is moving from the upper limit position stop to the lower limit position stop and the second force becoming a constant when the pin reaches the lower limit position stop;

the first and second force together providing a back pressure to the fixed scroll.

2. The back pressure regulation mechanism as claimed in claim 1, wherein a first stop member partially extends into the bore to define the upper limit position stop.

3. The back pressure regulation mechanism as claimed in claim 1, wherein a bolt having an expanded head is mounted to the spacing member with the head partially extending into the bore for defining the upper limit position stop.

4. The back pressure regulation mechanism as claimed in claim 1, wherein a circumferential protrusion is formed on an inner surface of the bore for defining the upper limit position stop.

5. The back pressure regulation mechanism as claimed in claim 1 further comprising an O-ring fixed around the boss of the fixed scroll.

6. The back pressure regulation mechanism as claimed in claim 1 further comprising an O-ring fixed around the pin of each back pressure regulation devices.

7. The back pressure regulation mechanism as claimed in claim 1, wherein the first and second forces acting upon the boss and the pins together provide a desired back pressure to the fixed scroll.

8. The back pressure regulation mechanism as claimed in claim 1, wherein when the pins reach the lower limit position stop, a back pressure acting upon the fixed scroll is equal to the sum of the constant second force plus the first force that is determined by the pressure difference.

9. The back pressure regulation mechanism as claimed in claim 1, wherein a second stop member partially extends into the bore to define the lower limit position stop.

10. The back pressure regulation mechanism as claimed in claim 9, wherein the second stop member comprises a protrusion formed on an inner surface of the bore, the protrusion forming a shoulder for engaging and thus stopping the movement of the pin.

11. The back pressure regulation mechanism as claimed in claim 1, wherein a disk is arranged under the bore and partially extends into the bore for defining the lower limit position stop.

12. The back pressure regulation mechanism as claimed in claim 11, wherein the disk is attached to the spacing member by bolts and is positioned between the spacing member and the fixed scroll, the disk defining a central hole for extension of the boss of the fixed scroll and a secondary hole corresponding to each of the bores, the secondary hole having a diameter smaller than a diameter of the corresponding bore so as to partially extend into the bore for defining the lower limit position stop.

* * * * *